US007404232B2

(12) United States Patent
Chase

(10) Patent No.: US 7,404,232 B2
(45) **Date of Patent: *Jul. 29, 2008**

(54) FURNITURE GLIDE ASSEMBLY

(76) Inventor: John Chase, 1919 Vinsetta Ct., Rochester, MI (US) 48306

( * ) Notice: Subject to any disclaimer, the term of this patent is extended or adjusted under 35 U.S.C. 154(b) by 235 days.

This patent is subject to a terminal disclaimer.

(21) Appl. No.: 11/252,024

(22) Filed: Oct. 17, 2005

(65) Prior Publication Data

US 2006/0053587 A1 Mar. 16, 2006

Related U.S. Application Data

(63) Continuation-in-part of application No. 10/941,162, filed on Sep. 15, 2004, now Pat. No. 7,234,200.

(51) Int. Cl.
*A47B 91/06* (2006.01)

(52) U.S. Cl. ..... 16/42 T; 16/42 R; 248/188.9

(58) Field of Classification Search ..... 16/43, 16/42 R, 42 T; 248/677, 188.8, 188.9, 346.11; 297/16.1–16.2, 463.1–463.2; D8/274
See application file for complete search history.

(56) References Cited

U.S. PATENT DOCUMENTS

| | | | | | |
|---|---|---|---|---|---|
| D33,589 | S | | 11/1900 | Higgins | D8/107 |
| 870,770 | A | | 11/1907 | Fuller | |
| 934,005 | A | * | 9/1909 | Neuberth | 16/30 |
| 1,389,572 | A | * | 9/1921 | Berg | 248/188.4 |
| 1,604,293 | A | * | 10/1926 | Lehmann | 16/42 R |
| 1,903,609 | A | | 4/1933 | Uhl | 16/42 R |
| 1,921,561 | A | * | 8/1933 | Christmas | 248/188.9 |
| 2,457,723 | A | | 12/1948 | Pura | 16/32 |
| 2,546,492 | A | * | 3/1951 | Booth | 248/188.8 |
| 2,637,063 | A | | 5/1953 | Becker | 16/42 R |
| 2,641,016 | A | | 6/1953 | Kramesak, Jr. | 16/39 |
| 2,644,978 | A | | 7/1953 | Becker | 16/42 |
| 2,687,547 | A | | 8/1954 | Matter | 16/30 |
| D173,835 | S | | 1/1955 | Chapman et al. | D8/374 |
| 2,738,541 | A | | 3/1956 | Thornsbury | 16/42 R |
| 2,902,794 | A | * | 9/1959 | Ehrgott | 248/188.9 |
| 3,000,042 | A | * | 9/1961 | Reynolds | 16/42 R |
| 3,191,213 | A | | 6/1965 | Congdon | 16/42 R |
| 3,363,280 | A | | 1/1968 | LeVasseur | 16/42 R |
| 3,389,421 | A | | 6/1968 | Wheeler | 16/42 R |

(Continued)

FOREIGN PATENT DOCUMENTS

| | | |
|---|---|---|
| DE | 40 30 557 C1 | 9/1991 |

OTHER PUBLICATIONS

Sep. 16, 2005 Office Action in connection with U.S. Appl. No. 10/941,162, filed Sep. 15, 2004.

(Continued)

*Primary Examiner*—Chuck Y. Mah
(74) *Attorney, Agent, or Firm*—Bliss McGlynn, P.C.

(57) ABSTRACT

A glide assembly is adapted to be removably mounted to the free end of a leg of a piece of furniture. The glide assembly includes a body defining a bore extending partially through the body to define an interior surface and an opened end of the body. An insert is removably mountable about the free end of the leg and disposed within the bore of the body so as to fixedly secure the body about the free end of the leg.

9 Claims, 3 Drawing Sheets

U.S. PATENT DOCUMENTS

| | | | | |
|---|---|---|---|---|
| 3,641,620 | A | 2/1972 | Hage | 16/19 |
| 3,722,026 | A * | 3/1973 | Wilhelmi | 16/42 T |
| 4,731,901 | A | 3/1988 | Daniels | 16/42 R |
| 4,754,714 | A | 7/1988 | Drumm | 108/157.18 |
| 5,081,740 | A | 1/1992 | Smith | 16/42 R |
| 5,191,676 | A | 3/1993 | Gerner | 16/42 |
| 5,220,705 | A | 6/1993 | Bushey | 16/42 R |
| D340,638 | S | 10/1993 | Campbell | D8/374 |
| 5,426,818 | A | 6/1995 | Bushey | 16/42 R |
| D376,753 | S | 12/1996 | Nakamura | D8/374 |
| D383,377 | S | 9/1997 | Sellers | D8/374 |
| 6,324,725 | B1 | 12/2001 | Green | 16/42 T |
| 6,354,231 | B1 * | 3/2002 | Morris | 108/144.11 |
| 6,405,982 | B2 | 6/2002 | Ferencz | 248/188.9 |
| 6,471,622 | B1 | 10/2002 | Hammer et al. | 482/54 |
| 6,623,082 | B1 | 9/2003 | Huang | 297/463.1 |
| 6,626,405 | B1 | 9/2003 | Keast et al. | 248/188.9 |
| D487,392 | S * | 3/2004 | Chase | D8/374 |
| 6,719,256 | B2 * | 4/2004 | Rydell et al. | 248/346.11 |
| 6,754,934 | B1 | 6/2004 | Shiffler | 16/42 R |
| 6,883,763 | B2 | 4/2005 | Bosman et al. | 248/188.9 |
| 2003/0163894 | A1 | 9/2003 | Jones et al. | 16/42 R |

OTHER PUBLICATIONS

Nov. 2, 2005 Final Office Action in connection with U.S. Appl. No. 10/941,162, filed Sep. 15, 2004.

Mar. 14, 2006 Office Action in connection with U.S. Appl. No. 10/941,162, filed Sep. 15, 2004.

05/012006 Final Office Action in connection with U.S. Appl. No. 10/941,162, filed Sep. 15, 2004.

Oct. 10, 2006 Office Action in connection with U.S. Appl. No. 10/941,162, filed Sep. 15, 2004.

* cited by examiner

FURNITURE GLIDE ASSEMBLY

This is a continuation-in-part application of and claims benefit to U.S. patent application Ser. No. 10/941,162 filed Sep. 15, 2004 now U.S. Pat. No. 7,234,200 and entitled "Furniture Glide Assembly."

BACKGROUND OF THE INVENTION

1. Field of the Invention

The present invention relates, generally, to a glide that is mountable to a leg of a piece of furniture and, in particular, to a glide assembly fixedly securable about a leg of a chair or desk.

2. Description of the Related Art

The free end of each leg of a piece of furniture often includes a cap, foot, or glide to allow easy sliding of the piece of furniture over the surface on which it is supported, such as a floor. More specifically, the feet, for example, of a chair or desk are designed to increase the amount of surface-area contact and reduce the amount of frictional contact between the respective legs and the floor.

One type of foot commonly employed in the related art generally includes an attachment portion and a gliding portion. The attachment portion is adapted to be fixedly secured to the free end of a leg, and the gliding portion is operatively connected to the end of the attachment portion opposite the leg. The gliding portion has a flat surface made of a hard, durable material, such as metal or nylon, and is adapted to be in operative contact with the floor.

However, this type of foot suffers from the disadvantage that when the chair or desk is moved along the floor, frictional contact between the foot and the floor produces a perceptible noise. In a classroom setting, especially in an elementary school where many relatively young students can be moving or "scooting" their respective chairs and desks at any one time, this noise can be multiplied to a very significant level. Also, this type of foot suffers from the disadvantage that the flat surface collects sand, dirt, and other debris. Furthermore, this type of foot suffers from the disadvantage that the flat surface can produce rust marks on the floor. In addition, a tool is often required to fixedly secure/remove this type of foot to/from the respective leg. Moreover, this type of foot suffers from the disadvantage that the angle at which the flat surface of the gliding portion operatively contacts the floor may be different from leg to leg and/or chair to chair, for instance, depending upon the relationship of each leg of the chair with the floor. As such, only an insufficient portion of the flat surface may actually operatively contact the floor.

To overcome these disadvantages in the related art, educators and maintenance personnel have sometimes employed tennis balls as makeshift glides for respective legs of chairs and desks. More specifically, an opened-ended hole is cut in a tennis ball to accommodate the free end of a leg. While ingenious, this approach has been deemed objectionable as unsightly and unprofessional. Also, this type and other similarly shaped types of glide suffer from the disadvantage that they cannot be fixedly secured to the free end of the leg. As a result, when the chair or desk is moved along the floor, the amount of frictional contact between the glide and the free end of the leg may not be sufficient to retain the glide in place about the leg. In fact, as the chair or desk is moved, the glide can slide down the free end of the leg such that the glide can even slide off the leg. Furthermore, in a classroom setting, especially in an elementary school, the relatively young students can manually remove the glides. In either event, at least one glide missing from a chair or desk can cause the chair or desk to wobble and, thus, be functionally inferior. In addition, glides of any type made of a hard, durable rubber can grind into and, thus, mar the floor over which the chair or desk is slid.

The caps, feet, and glides of the related art suffer also from the disadvantage that only few, if any, of them are designed to be employed with a leg defining a substantially rectangular cross-section. More specifically, most of them are designed to be employed with only a leg defining a circular cross-section. However, about twenty percent of existing chairs and desks and those being manufactured have legs each defining a substantially rectangular cross-section. As such, there is a significant number of chairs and desks having a particular need that is not being sufficiently met.

Thus, there is a need in the related art for a glide that can be fixedly secured to the free end of a leg of a piece of furniture such that it can be retained to the leg when the piece of furniture is moved along a floor while maintaining sufficient contact with the floor. Similarly, there remains a need in the related art for a glide that cannot be manually removed from the leg by relatively young students in a classroom setting, especially in an elementary school. There is also a need in the related art for a glide that does not mar the floor or produce a perceptible noise or rust marks on the floor when the piece of furniture is moved along the floor. There is also a need in the related art for a glide that does not require a tool to fixedly secure/remove the glide to/from the leg. There is also a need in the related art for a glide that is sightly and professional. There is also a need in the related art for a glide that does not collect sand, dirt, and other debris. There is also a need in the related art for a glide a sufficient portion of which operatively contacts the floor. There is also a need in the related art for a glide that is designed to be employed with a leg defining a substantially rectangular cross-section.

SUMMARY OF THE INVENTION

The invention overcomes the disadvantages in the related art in a glide assembly adapted to be removably mounted to the free end of a leg of a piece of furniture. The glide assembly includes a body defining a bore extending partially through the body to define an interior surface and an opened end of the body. An insert is removably mountable to the free end of the leg and disposed within the bore of the body so as to fixedly secure the body about the free end of the leg.

The furniture glide assembly of the present invention can be fixedly secured about the free end of the leg of the piece of furniture. As a result, the assembly can be retained about the leg when the piece of furniture is moved along a floor while maintaining sufficient contact with the floor. In the same manner, the assembly cannot be manually removed from the leg by relatively young students in a classroom setting, especially in an elementary school. Likewise, the assembly is made of a soft PVC material and, thus, does not mar or produce rust marks on the floor or produce a perceptible noise when the furniture is moved along the floor. Similarly, a tool is not required to fixedly secure/remove the assembly about/from the leg. Also, the assembly is sightly and professional. Furthermore, the assembly does not collect sand, dirt, and other debris. Moreover, the assembly is of a one-piece design and, therefore, easier to fixedly secure about the leg and costs less to ship relative to glides of the related art of a multi-piece design.

Other objects, features, and advantages of the present invention will be readily appreciated as the same becomes better understood after reading the subsequent description taken in conjunction with the accompanying drawings.

DETAILED DESCRIPTION OF THE INVENTION

Figure 1:
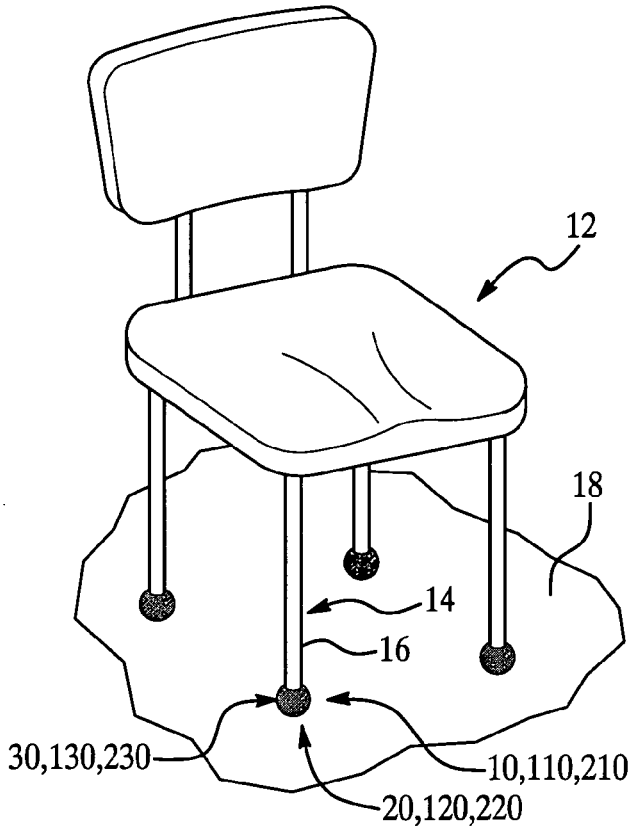
FIG. 1 is an environmental view of a chair showing the furniture glide assembly of the present invention fixedly secured about the free end of each of four legs of the chair.

A furniture glide assembly according to the present invention is generally indicated at 10, 110, 210 in FIGS. 1 through 10, where like numerals are used to designate like structure throughout the various embodiments of the assembly 10, 110, 210 disclosed herein. The assembly 10, 110, 210 is adapted to be removably mounted about the free end 16 of each leg, generally indicated at 14, of a piece of furniture, generally indicated at 12 in FIG. 1. The piece of furniture 12, in general, and the legs 14, in particular, are adapted to be supported by a surface, such as a floor 18.

The assembly 10, 110, 210 is described below and shown in FIG. 1 used in connection with a chair 12. However, it should be appreciated by those having ordinary skill in the related art that the assembly 10, 110, 210 can be used in connection with any suitable piece of furniture, such as a desk. It should also be appreciated that the assembly 10, 110, 210 can find special application when used in connection with chairs and desks of a classroom. The details of each assembly 10, 110, 210 are described below with reference to FIGS. 2-4, 5-7, and 8-10, respectively.

Still referring to FIG. 1, the free end 16 of each leg 14 is substantially cylindrical and relatively narrow and defines a longitudinal central axis and a substantially circular horizontal cross-section. However, it should be appreciated by those having ordinary skill in the related art that the free end 16 of the leg 14 can have any suitable size and shape, such as defining a substantially rectangular horizontal cross-section. It should also be appreciated that the free end 16 of the leg 14 can have any suitable structure, such as being hollow or solid and opened-ended or closed-ended.

In general, the assembly 10, 110, 210 is adapted to be removably mounted to the free end 16 of the leg 14. To this end, the assembly 10, 110, 210 includes a body, generally indicated at 20, 120, 220, defining a bore 22, 122, 222 extending partially through the body 20, 120, 220 to define an interior surface 24, 124, 224 and an opened end 26, 126, 226 of the body 20, 120, 220. An insert, generally indicated at 28, 128, 228, is removably mountable about the free end 16 of the leg 14 and disposed within the bore 22, 122, 222 so as to fixedly secure the body 20, 120, 220 about the free end 16 of the leg 14.

More specifically, the body 20, 120, 220 is substantially spherical and solid and defines a central axis "A" and an exterior surface, generally indicated at 30, 130, 230, adapted to be disposed in contact with the floor 18. The bore 22, 122, 222 is substantially cylindrical and extends through nearly the entire body 20, 120, 220 such that the bore 22, 122, 222 defines a closed end 32, 132, 232 of the body 20, 120, 220. The central longitudinal axis of the bore 22, 122, 222 defines the axis "A" of the body 20, 120, 220. The bore 22, 122, 222 is adapted to be coaxial with the free end 16 of the leg 14.

However, it should be appreciated by those having ordinary skill in the related art that the body 20, 120, 220 can have any suitable arcuate shape, size, and structure, such as being hollow. It should also be appreciated that the bore 22, 122, 222 can extend any suitable distance through the body 20, 120, 220 and have any suitable structural relationship with respect to the axis "A" of the body 20, 120, 220. Similarly, the bore 22, 122, 222 can have any suitable shape and size such that the insert 28, 128, 228 can be disposed within the bore 22, 122, 222 and structural relationship with respect to the free end 16 of the leg 14 so as to fixedly secure the body 20, 120, 220 about the free end 16 of the leg 14.

The exterior surface 30, 130, 230 of the body 20, 120, 220 includes a plurality of raised surfaces 31, 131, 231 adapted to facilitate smooth frictional contact between the assembly 10, 110, 210 and the floor 18 on which the assembly 10, 110, 210 is supported. In the embodiment shown, the raised surfaces 31, 131, 231 are substantially non-uniformly shaped and non-contacting with respect to each other, substantially smooth, and raised a substantially equal height above the exterior surface 30, 130, 230 of the body 20, 120, 220, which is only a slight amount relative to the radius of the body 20, 120, 220. The exterior surface 30, 130, 230 also defines a substantially uniform circular and planar rim 34, 134, 234 completely encircling the opened end 26, 126, 226 of the body 20, 120, 220.

However, it should be appreciated by those having ordinary skill in the related art that the exterior surface 30, 130, 230 of the body 20, 120, 220 can include any suitable number of raised surfaces 31, 131, 231. In turn, the raised surfaces 31, 131, 231 can have any suitable shape, size, and texture and structural relationship with respect to each other and the body 20, 120, 220. For instance, the raised surfaces 31, 131, 231 can be substantially uniformly shaped and contacting with respect to each other, substantially rough, and raised a substantially unequal height above the exterior surface 30, 130, 230 of the body 20, 120, 220. Alternatively, the exterior surface 30, 130, 230 of the body 20, 120, 220 can include no raised surfaces 31, 131, 231 and be substantially smooth. It should also be appreciated that the rim 34, 134, 234 of the exterior surface 30, 130, 230 can have any suitable size, shape, and structure and structural relationship with the remainder of the exterior surface 30, 130, 230. Alternatively, the exterior surface 30, 130, 230 of the body 20, 120, 220 can define no rim and be completely arcuate.

Thus, while there are three different embodiments of the assembly 10, 110, 210 disclosed herein, those having ordinary skill in the related art should appreciate that, within the scope of the appended claims, other means of providing the removable mounting of the assembly 10, 110, 210 to the free end 16 of the leg 14 may be possible without departing from the scope of the present invention. Accordingly, the various embodiments of the present invention illustrated in the figures will be described in greater detail below.

Figure 2:
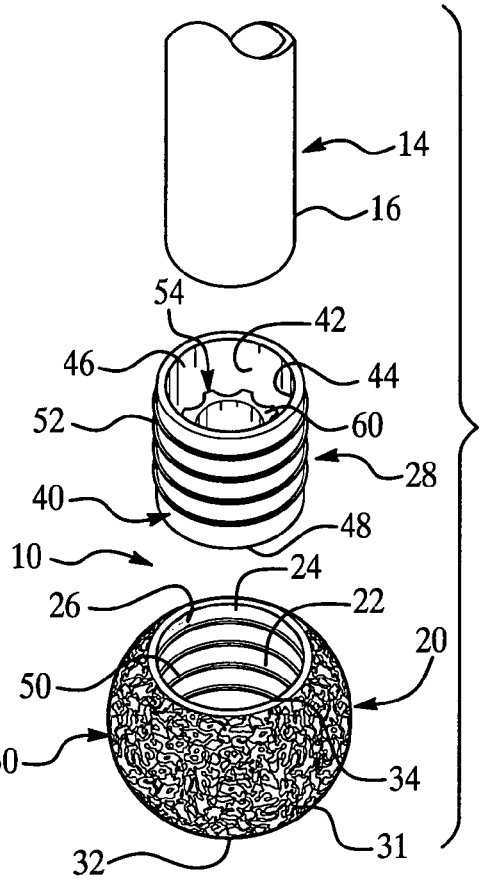
FIG. 2 is an exploded assembly view of a first embodiment of the furniture glide assembly of the present invention.
Figure 3:
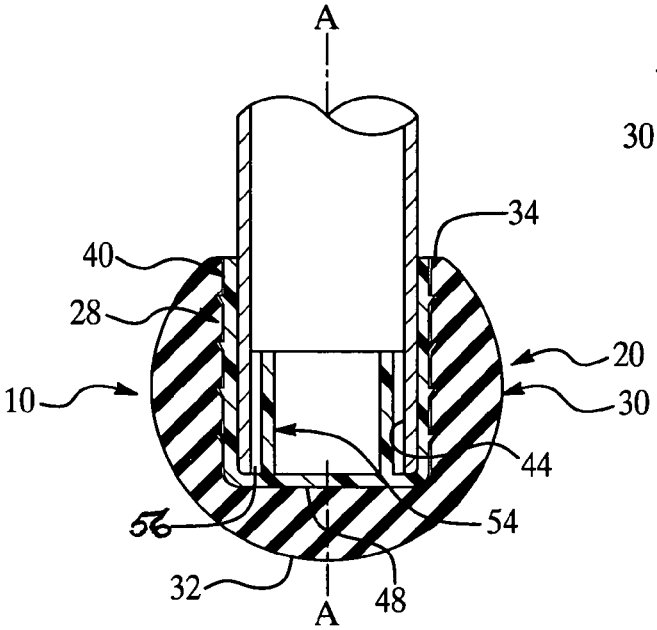
FIG. 3 is a cross-sectional side view of the first embodiment of the furniture glide assembly of the present invention.
Figure 4:
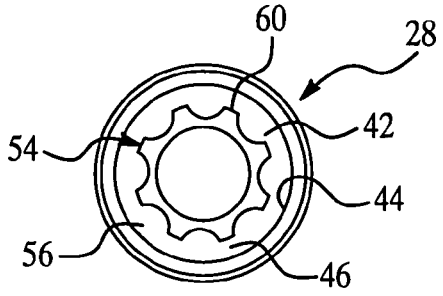
FIG. 4 is a top view of the insert of the first embodiment of the furniture glide assembly of the present invention.

More specifically and referring now to FIGS. 2 through 4, the structure of the assembly 10 will be addressed. In this embodiment, the insert 28 is substantially cylindrical. The insert 28 defines an exterior surface, generally indicated at 40, and a passageway 42 extending at least partially through the insert 28 to define a hollow interior 42 and at least one opened end 46 of the insert 28. In the embodiment shown, the insert 28 defines a single opened end 46. The free end 16 of the leg 14 is adapted to be matingly received through the opened end 46 and within the hollow interior 42 of the insert 28 to removably mount the insert 28 about the free end 16 of the leg 14. Also in the embodiment shown, the top of the insert 28 is disposed substantially flush with the top of the body 20.

However, it should be appreciated by those having ordinary skill in the related art that the insert 28 can have any suitable shape and size so as to be receivable through the opened end 26 and within the bore 22 of the body 20. For instance, the top of the insert 28 can be disposed any suitable distance above or below the top of the body 20. It should also be appreciated that the passageway 42 can extend any suitable distance through the insert 28, such as entirely through the insert 28 to define two opposed opened ends 46 of the insert 28. Similarly, the passageway 42 can have any suitable structural relationship with respect to the insert 28. The passageway 42 can have any suitable shape and size and structural relationship with respect to the free end 16 of the leg 14 so as to receive the free end 16 of the leg 14.

As shown in FIG. 2, the hollow interior surface 24 of the body 20 includes at least one groove 50, and the exterior surface 40 of the insert 28 includes at least one rib 52 adapted to cooperate with the at least one groove 50 to fixedly secure the body 20 about the insert 28. In the embodiment shown, the hollow interior surface 24 includes four grooves 50, and the exterior surface 40 of the insert 28 includes four ribs 52 adapted to correspondingly cooperate with the four grooves 50 to fixedly secure the body 20 about the insert 28. The four grooves 50 are substantially equidistantly spaced and disposed substantially parallel with respect to each other and perpendicular to the free end 16 of the leg 14. Also, each groove 50 is disposed substantially entirely about the bore 22 of the body 20, and the corresponding rib 52 is disposed substantially entirely about the exterior surface 40 of the insert 28.

However, it should be appreciated by those having ordinary skill in the related art that the hollow interior surface 24 of the body 20 can include any suitable number of grooves 50 and the exterior surface 40 of the insert 28 can include any suitable number of ribs 52 adapted to cooperate with the groove(s) 50 to fixedly secure the body 20 about the insert 28. It should also be appreciated that each groove 50 can have any suitable shape and size and structural relationship with respect to each of any of the other grooves 50, the free end 16 of the leg 14, and the bore 22 of the body 20. In turn, it should also be appreciated that each rib 52 can have any suitable shape and size and structural relationship with respect to each of any of the other ribs 52 so as to cooperate with the groove(s) 50 to fixedly secure the body 20 about the insert 28.

For the case in which the free end 16 of the leg 14 is hollow and opened-ended to define an interior surface of the free end 16 of the leg 14 and as shown in FIGS. 2 through 4, the hollow interior 42 of the insert 28 defines a hollow interior surface 44 of the insert 28. The passageway 42 of the insert 28 includes a closed end 48 located opposite the opened end 46 of the insert 28. The insert 28 may also include a post, generally indicated at 54, extending from the closed end 48 toward the opened end 46 of the insert 28. As shown in FIGS. 3 and 4, a volume 56 of the passageway 42 is defined about the post 54. The post 54 is adapted to be received through the opening of and within the free end 16 of the leg 14 with the outer surface of the free end 16 of the leg 14 being adapted to be matingly received in the volume 56 between the post 54 and the hollow interior surface 44 of the insert 28 to removably mount the insert 28 about the free end 16 of the leg 14.

In the embodiment shown, the post 54 is substantially cylindrical and coaxial with respect to the passageway 42 such that the volume 56 of the passageway 42 defined about the post 54 is substantially uniform. The post 54 also extends only partially from the closed end 48 toward the opened end 46 of the insert 28. However, it should be appreciated by those having ordinary skill in the related art that the post 54 can have any suitable shape and size and structural relationship with respect to the passageway 42. It should also be appreciated that the post 54 can extend any suitable distance from the closed end 48 toward the opened end 46 of the insert 28 such that the outer surface of the free end 16 of the leg 14 is matingly received in the volume 56 between the post 54 and the hollow interior surface 44 of the insert 28 to removably mount the insert 28 about the free end 16 of the leg 14.

To this end and as shown in FIGS. 2 and 4, the post 54 defines a plurality of ribs 60 extending axially along the post 54. The ribs 60 are adapted to be in frictional contact with the interior surface of the free end 16 of the leg 14 so as to create an interference fit between the ribs 60 and such interior surface and, thus, removably mount the insert 28 about the free end 16 of the leg 14. In the embodiment shown, the ribs 60 are substantially equidistantly spaced about substantially the entire post 54. The ribs 60 are also disposed substantially parallel with respect to each other and the free end 16 of the leg 14 and perpendicular to the ribs 60 of the exterior surface 40 of the insert 28. Also, each rib 60 is disposed substantially entirely along the post 54.

It should be appreciated by those having ordinary skill in the related art that the post 54 can define any suitable plural number of ribs 60. It should also be appreciated that each rib 60 can extend in any suitable direction with respect to the post 54 so as to be in frictional contact with the interior surface of the free end 16 of the leg 14. The ribs 60 can have any suitable shape and size and structural relationship with respect to each other and the post 54. On the other hand, where the free end 16 of the leg 14 is closed, the insert 28 does not include the post 54.

Figure 5:
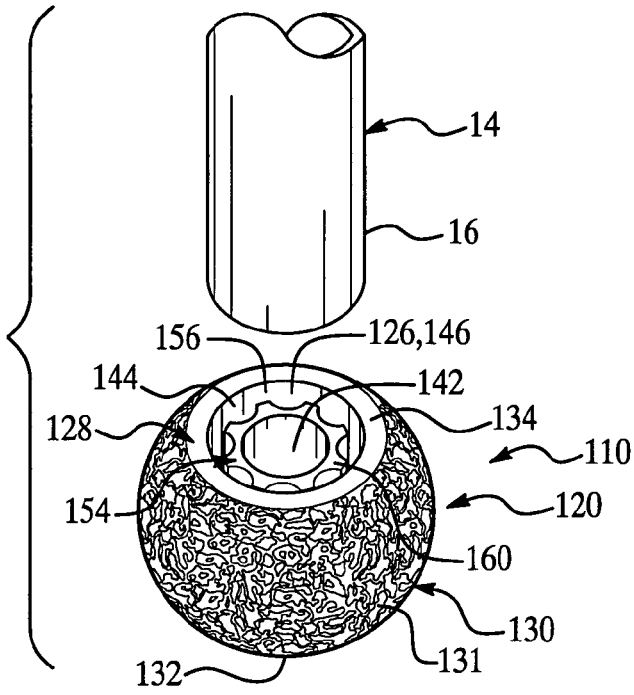
FIG. 5 is an exploded assembly view of a second embodiment of the furniture glide assembly of the present invention.
Figure 6:
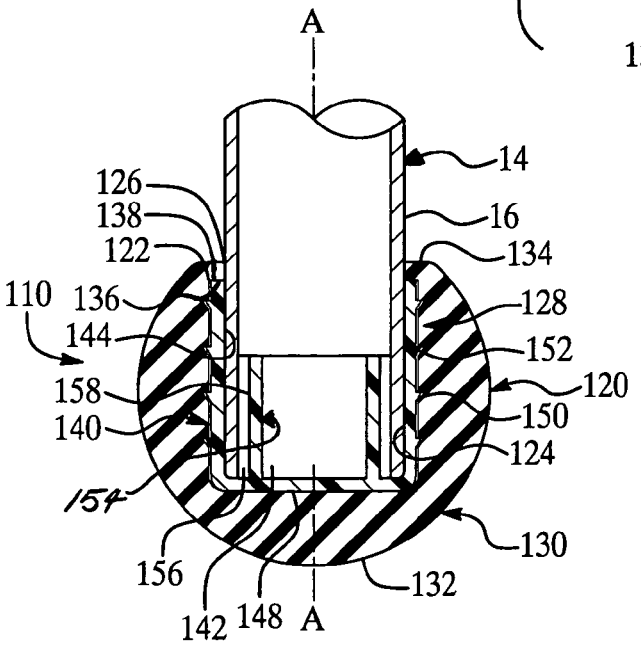
FIG. 6 is a cross-sectional side assembly view of the second embodiment of the furniture glide assembly of the present invention.
Figure 7:
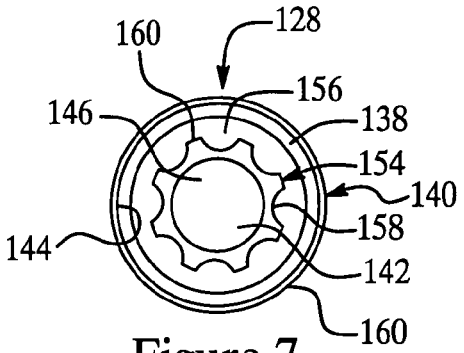
FIG. 7 is a top view of the insert of the second embodiment of the furniture glide assembly of the present invention.

Referring now to FIGS. 5 through 7, the structure of the assembly 110 will be addressed. Parts of the assembly 110 corresponding to those of the assembly 10 have like reference numerals with respect to the assembly 10, but increased by one hundred (100). In this embodiment, the bore 122 defines a substantially circular horizontal cross-section. The bore 122 and interior surface 124 of the body 120 define a substantially uniform rim 136 that completely encircles an uppermost volume of the bore 122. The rim 136 defines a substantially circular horizontal cross-section and a substantially trapezoidal vertical cross-section. A substantially planar top surface of the rim 136 is the rim 134 of the exterior surface 130 of the body 120. A substantially planar bottom surface of the rim 136 is adapted to contact the corresponding substantially planar facial surface 138 of the insert 128 in a substantially flush manner. In this way, the rim 136 fixedly secures disposition of the entire insert 128 within the bore 122.

In this embodiment, the insert 128 is substantially cylindrical to define a substantially circular horizontal cross-section. The central longitudinal axis of the insert 128 defines the axis "A" of the body 120. The insert 128 also defines an exterior surface, generally indicated at 140, and a passageway 142 extending at least partially through the insert 128 to define an interior surface 144 and at least one opened end 146 of the insert 128. In the embodiment shown, the central longitudinal axis of the passageway 142 defines the axis "A" of the body 120, and the insert 128 defines a single opened end 146 and a closed end 148 located opposite the opened end 146 such that the insert 128 defines a substantially U-shaped vertical cross-section the legs and base of which are of substantially uniform thickness.

The exterior surface 140 of the insert 128 is adapted to contact the interior surface 124 of the body 120 in a substantially flush manner such that the insert 128 is disposed substantially symmetrically within the body 120. The free end 16 of the leg 14 is adapted to be matingly received through the opened end 146 and within the passageway 142 of the insert 128 such that the free end 16 of the leg 14 contacts the interior surface 144 of the insert 128 in a substantially flush manner to removably mount the insert 128 about the free end 16 of the leg 14.

The insert 128 is substantially encased by the body 120 so as to fixedly secure the body 120 substantially completely about the insert 128. More specifically, the plane defined by the opened end 146 of the insert 128 lies interior the plane defined by the opened end 126 of the body 120. The distance between the bottom surface of the closed end 132 of the body 120 (the bottom surface of the exterior surface 130 of the body 120) and the top surface of the closed end 148 of the body 120 (the bottom surface of the interior surface 124 of the body 120) is greater than the distance between the opened end 126 of the body 120 and the opened end 146 of the insert 128 via the axis "A." Whereas, the distance between the bottom surface of the closed end 132 of the insert 128 (the bottom surface of the exterior surface 140 of the insert 128) and the top surface of the closed end 148 of the insert 128 (the bottom surface of the interior surface 144 of the insert 128) is substantially equal to the distance between the opened end 126 of the body 120 and the opened end 146 of the insert 128 via the axis "A."

However, it should be appreciated by those having ordinary skill in the related art that the insert 128 can have any suitable shape, size, and structure and structural relationship with the bore 122 so as to be disposable within the bore 122. For instance, the facial surface 138 of the insert 128 can be disposed any suitable distance below the opened end 126 of the body 120. It should also be appreciated that the passageway 142 can extend any suitable distance through the insert 128, such as entirely through the insert 128 to define two opposed opened ends 146 of the insert 128. Similarly, the passageway 142 can have any suitable shape and size and structural relationship with respect to the insert 128 and free end 16 of the leg 14 so as to removably receive the free end 16 of the leg 14.

In the embodiment shown, the interior surface 124 of the body 120 defines at least one relatively shallow groove 150, and the exterior surface 140 of the insert 128 includes at least one rib 152 adapted to cooperate with the at least one groove 150 to fixedly secure the body 120 about the insert 128. More specifically, the interior surface 124 of the body 120 defines six grooves 150, and the insert 128 includes six ribs 152 adapted to correspondingly cooperate with the six grooves 150 to fixedly secure the body 120 about the insert 128. The six grooves 150 are disposed substantially equidistantly spaced and parallel with respect to each other and perpendicular with respect to the axis "A" and free end 16 of the leg 14. Also, each groove 150 is disposed substantially entirely about the bore 122 of the body 120, and the corresponding rib 152 is disposed substantially entirely about the exterior surface 140 of the insert 128.

However, it should be appreciated by those having ordinary skill in the related art that the interior surface 124 of the body 120 can define any suitable number of grooves 150 and the exterior surface 140 of the insert 128 can include any suitable number of ribs 152 adapted to cooperate with the groove(s) 150 to fixedly secure the body 120 about the insert 128. It should also be appreciated that each groove 150 can have any suitable shape and size and structural relationship with respect to each of any of the other grooves 150, the corresponding rib 152, and the bore 122 of the body 120. In turn, it should also be appreciated that each rib 152 can have any suitable shape and size and structural relationship with respect to each of any of the other ribs 152 so as to cooperate with the groove(s) 150 to fixedly secure the body 120 about the insert 128.

It should further be appreciated that neither the groove(s) 150 nor the rib(s) 152 is/are necessary. Thus, in an alternative embodiment of the assembly 110 (not shown), the interior surface 124 of the body 120 is substantially smooth and defines no grooves, and the exterior surface 140 of the insert 128 is substantially smooth and includes no ribs. The rim 136 of the body 120 fixedly secures disposition of the entire insert 128 within the bore 122.

For the case in which the free end 16 of the leg 14 is hollow and opened-ended to define an interior surface (not shown) and a substantially circular horizontal cross-section of the free end 16 of the leg 14, the insert 128 may also include a post, generally indicated at 154, extending from the closed end 148 toward the opened end 146 of the insert 128. A volume 156 of the passageway 142 is defined about the post 154. The post 154 is adapted to be received through the opening (not shown) of and within the free end 16 of the leg 14 with the free end 16 of the leg 14 being adapted to be matingly received in the volume 156 defined between the post 154 and the interior surface 144 of the insert 128 to removably mount the insert 128 about the free end 16 of the leg 14.

In the embodiment shown, the post 154 is substantially cylindrical, hollow, and completely open-ended and defines a substantially circular horizontal cross-section and an exterior surface 158 of the post 154. The central longitudinal axis of the post 154 defines the axis "A" such that the volume 156 of the passageway 142 defined about the post 154 is substantially uniform and the distance between the exterior surface 158 of the post 154 and the interior surface 144 of the insert 128 is less than the radius of the post 154. The post 154 also extends integrally and only partially from the closed end 148 toward the opened end 146 of the insert 128 such that the post 154 is disposed entirely interior the plane defined by the opened end 146 of the insert 128. The post 152 has a substantially uniform thickness, which is substantially equal to or less than that of the insert 128.

However, it should be appreciated by those having ordinary skill in the related art that the post 154 can have any suitable shape, size, and structure and structural relationship with respect to the passageway 142 and remainder of the insert 128. It should also be appreciated that the post 154 can extend any suitable distance from the closed end 148 toward the opened end 146 of the insert 128 such that the free end 16 of the leg 14 is matingly received in the volume 156 defined between the post 154 and the interior surface 144 of the insert 128 to removably mount the insert 128 about the free end 16 of the leg 14.

To this end, the exterior surface 158 of the post 154 includes at least one rib 160 adapted to be in frictional contact with the interior surface of the free end 16 of the leg 14 to removably mount the insert 128 about the free end 16 of the leg 14. More specifically, the exterior surface 158 of the post 154 includes a plurality of ribs 160 disposed substantially parallel with respect to the axis "A." The ribs 160 are sufficiently spaced from the interior surface 144 of the insert 128 such that they are adapted to be in frictional contact with the interior surface of the free end 16 of the leg 14 so as to create an interference fit between the ribs 160 and such interior surface and, thus, removably mount the insert 128 about the free end 16 of the leg 14.

In the embodiment shown, twelve substantially uniform ribs 160, each defining a substantially semi-elliptical horizontal cross-section, are disposed substantially equidistantly spaced about substantially the entire post 154. The ribs 160 are also disposed substantially parallel with respect to each other and the free end 16 of the leg 14 and perpendicular to the ribs 152 of the exterior surface 140 of the insert 128. Also, each rib 160 is disposed substantially entirely along the exterior surface 158 of the post 154.

It should be appreciated by those having ordinary skill in the related art that the post 154 can define any suitable number of ribs 160. The ribs 160 can have any suitable shape, size, and structure and structural relationship with respect to each other, the remainder of the post 154, and the free end 16 of the leg 14. On the other hand, where the free end 16 of the leg 14 is closed, the insert 128 does not include a post.

It should also be appreciated that the ribs 160 are not necessary. Thus, in an alternative embodiment of the assembly 110 (not shown), the exterior surface 158 of the post 154 is substantially smooth and defines no ribs. The exterior surface 158 is adapted to be in frictional contact with the interior surface of the free end 16 of the leg 14 so as to create an interference fit between the exterior surface 158 and such interior surface and, thus, removably mount the insert 128 about the free end 16 of the leg 14.

Figure 8:
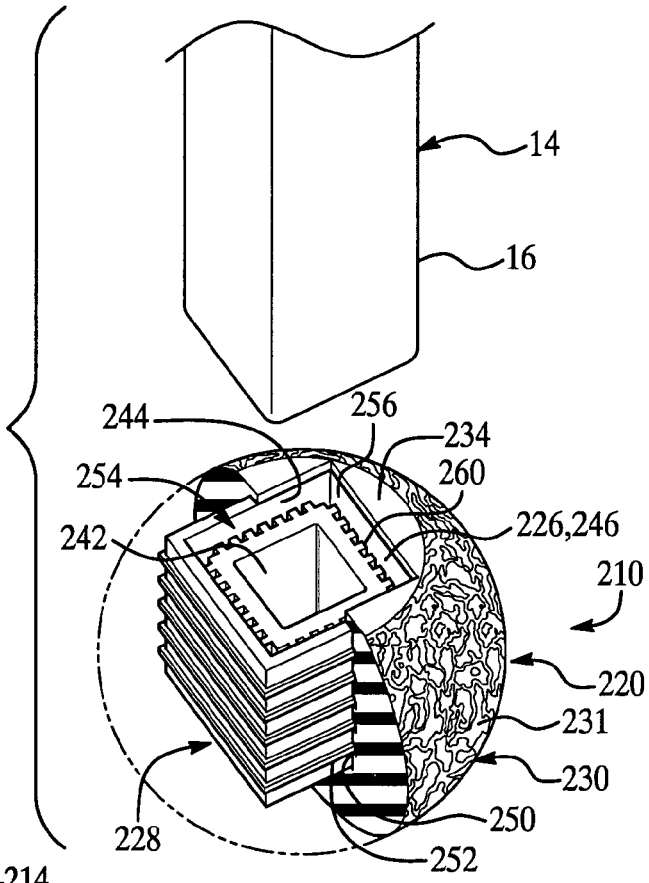
FIG. 8 is an exploded assembly view of a third embodiment of the furniture glide assembly of the present invention.
Figure 9:
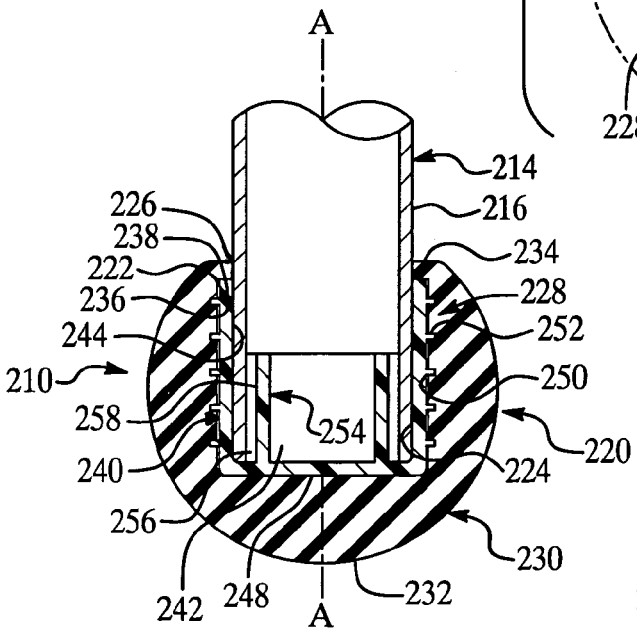
FIG. 9 is a cross-sectional side assembly view of the third embodiment of the furniture glide assembly of the present invention.
Figure 10:
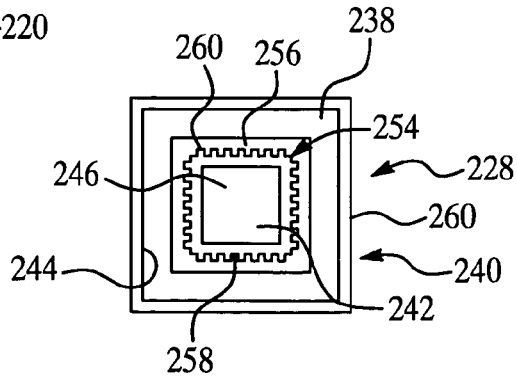
FIG. 10 is a top view of the insert of the third embodiment of the furniture glide assembly of the present invention.

Referring now to FIGS. 8 through 10, the structure of the assembly 210 will be addressed. Parts of the assembly 210 corresponding to those of the assembly 10 have like reference numerals with respect to the assembly 10, but increased by two hundred (200). In this embodiment, the bore 222 defines a substantially rectangular—preferably, square—horizontal cross-section. The bore 222 and interior surface 224 of the body 220 define a rim 236 that completely encloses an uppermost volume of the bore 222. The rim 236 defines a substantially rectangular—preferably, square—horizontal cross-section. A substantially planar top surface of the rim 236 is the rim 234 of the exterior surface 230 of the body 220. A substantially planar bottom surface of the rim 236 is adapted to contact the corresponding substantially planar facial surface 238 of the insert 228 in a substantially flush manner. In this way, the rim 236 fixedly secures disposition of the entire insert 228 within the bore 222.

In this embodiment, the insert 228 defines a substantially rectangular—preferably, square—horizontal cross-section. The central longitudinal axis of the insert 228 defines the axis "A" of the body 220. The insert 228 also defines an exterior surface, generally indicated at 240, and a passageway 242 extending at least partially through the insert 228 to define an interior surface 244 and at least one opened end 246 of the insert 228. In the embodiment shown, the central longitudinal axis of the passageway 242 defines the axis "A" of the body 220, and the insert 228 defines a single opened end 246 and a closed end 248 located opposite the opened end 246 such that the insert 228 defines a substantially U-shaped vertical cross-section the legs and base of which are of substantially uniform thickness.

The exterior surface 240 of the insert 228 is adapted to contact the interior surface 224 of the body 220 in a substantially flush manner such that the insert 228 is disposed substantially symmetrically within the body 220. The free end 16 of the leg 14 is adapted to be matingly received through the opened end 246 and within the passageway 242 of the insert 228 such that the free end 16 of the leg 14 contacts the interior surface 244 of the insert 228 in a substantially flush manner to removably mount the insert 228 about the free end 16 of the leg 14.

The insert 228 is substantially encased by the body 220 so as to fixedly secure the body 220 substantially completely about the insert 228. More specifically, the plane defined by the opened end 246 of the insert 228 lies interior the plane defined by the opened end 226 of the body 220. The distance between the bottom surface of the closed end 232 of the body 220 (the bottom surface of the exterior surface 230 of the body 220) and the top surface of the closed end 248 of the body 220 (the bottom surface of the interior surface 224 of the body 220) is greater than the distance between the opened end 226 of the body 220 and the opened end 246 of the insert 228 via the axis "A." Whereas, the distance between the bottom surface of the closed end 232 of the insert 228 (the bottom surface of the exterior surface 240 of the insert 228) and the top surface of the closed end 248 of the insert 228 (the bottom surface of the interior surface 244 of the insert 228) is substantially equal to the distance between the opened end 226 of the body 220 and the opened end 246 of the insert 228 via the axis "A."

However, it should be appreciated by those having ordinary skill in the related art that the insert 228 can have any suitable shape, size, and structure and structural relationship with the bore 222 so as to be disposable within the bore 222. For instance, the facial surface 238 of the insert 228 can be disposed any suitable distance below the opened end 226 of the body 220. It should also be appreciated that the passageway 242 can extend any suitable distance through the insert 228, such as entirely through the insert 228 to define two opposed opened ends 246 of the insert 228. Similarly, the passageway 242 can have any suitable shape and size and structural relationship with respect to the insert 228 and free end 16 of the leg 14 so as to removably receive the free end 16 of the leg 14.

In the embodiment shown, the interior surface 224 of the body 220 defines at least one relatively shallow groove 250, and the exterior surface 240 of the insert 228 includes at least one rib 252 adapted to cooperate with the at least one groove 250 to fixedly secure the body 220 about the insert 228. More specifically, the interior surface 224 of the body 220 defines five grooves 250, and the insert 228 includes five ribs 252 adapted to correspondingly cooperate with the five grooves 250 to fixedly secure the body 220 about the insert 228. The five grooves 250 are disposed substantially equidistantly spaced and parallel with respect to each other and perpendicular with respect to the axis "A" and free end 16 of the leg 14. Also, each groove 250 is disposed substantially entirely about the bore 222 of the body 220, and the corresponding rib 252 is disposed substantially entirely about the exterior surface 240 of the insert 228.

However, it should be appreciated by those having ordinary skill in the related art that the interior surface 224 of the body 220 can define any suitable number of grooves 250 and the exterior surface 240 of the insert 228 can include any suitable number of ribs 252 adapted to cooperate with the groove(s) 250 to fixedly secure the body 220 about the insert 228. It should also be appreciated that each groove 250 can have any suitable shape and size and structural relationship with respect to each of any of the other grooves 250, the corresponding rib 252, and the bore 222 of the body 220. In turn, it should also be appreciated that each rib 252 can have any suitable shape and size and structural relationship with respect to each of any of the other ribs 252 so as to cooperate with the groove(s) 250 to fixedly secure the body 220 about the insert 228.

It should further be appreciated that neither the groove(s) 250 nor the rib(s) 252 is/are necessary. Thus, in an alternative embodiment of the assembly 210 (not shown), the interior surface 224 of the body 220 is substantially smooth and defines no grooves, and the exterior surface 240 of the insert 228 is substantially smooth and includes no ribs. The rim 236 of the body 220 fixedly secures disposition of the entire insert 228 within the bore 222.

For the case in which the free end 16 of the leg 14 is hollow and opened-ended to define an interior surface (not shown) and a substantially rectangular—preferably, square—horizontal cross-section of the free end 16 of the leg 14, the insert 228 may also include a post, generally indicated at 254, extending from the closed end 248 toward the opened end 246 of the insert 228. A volume 256 of the passageway 242 is defined about the post 254. The post 254 is adapted to be received through the opening (not shown) of and within the free end 16 of the leg 14 with the free end 16 of the leg 14 being adapted to be matingly received in the volume 256 defined between the post 254 and the interior surface 244 of the insert 228 to removably mount the insert 228 about the free end 16 of the leg 14.

In the embodiment shown, the post 254 is substantially hollow and completely open-ended and defines a substantially rectangular—preferably, square—horizontal cross-section and an exterior surface 258 of the post 254. The central longitudinal axis of the post 254 defines the axis "A" such that the volume 256 of the passageway 242 defined about the post 254 is substantially uniform and the distance between the exterior surface 258 of the post 254 and the interior surface 244 of the insert 228 is less than the radius of the post 254. The post 254 also extends integrally and only partially from the closed end 248 toward the opened end 246 of the insert 228 such that the post 254 is disposed entirely interior the plane defined by the opened end 246 of the insert 228. The post 252 has a substantially uniform thickness, which is substantially equal to or less than that of the insert 228.

However, it should be appreciated by those having ordinary skill in the related art that the post 254 can have any suitable shape, size, and structure and structural relationship with respect to the passageway 242 and remainder of the insert 228. It should also be appreciated that the post 254 can extend any suitable distance from the closed end 248 toward the opened end 246 of the insert 228 such that the free end 16 of the leg 14 is matingly received in the volume 256 defined between the post 254 and the interior surface 244 of the insert 228 to removably mount the insert 228 about the free end 16 of the leg 14.

To this end, the exterior surface 258 of the post 254 includes at least one rib 260 adapted to be in frictional contact with the interior surface of the free end 16 of the leg 14 to removably mount the insert 228 about the free end 16 of the leg 14. More specifically, the exterior surface 258 of the post 254 includes a plurality of ribs 260 disposed substantially parallel with respect to the axis "A." The ribs 260 are sufficiently spaced from the interior surface 244 of the insert 228 such that they are adapted to be in frictional contact with the interior surface of the free end 16 of the leg 14 so as to create an interference fit between the ribs 260 and such interior surface and, thus, removably mount the insert 228 about the free end 16 of the leg 14.

In the embodiment shown, twenty-eight substantially uniform ribs 260, each defining a substantially rectangular—preferably, square—horizontal cross-section, are disposed seven per side of the post 254 and substantially equidistantly spaced about substantially the entire post 254. The ribs 260 are also disposed substantially parallel with respect to each other and the free end 16 of the leg 14 and perpendicular to the ribs 252 of the exterior surface 240 of the insert 228. Also, each rib 260 is disposed substantially entirely along the exterior surface 258 of the post 254.

It should be appreciated by those having ordinary skill in the related art that the post 254 can define any suitable number of ribs 260. The ribs 260 can have any suitable shape, size, and structure and structural relationship with respect to each other, the remainder of the post 254, and the free end 16 of the leg 14. On the other hand, where the free end 16 of the leg 14 is closed, the insert 228 does not include a post.

It should also be appreciated that the ribs 260 are not necessary. Thus, in an alternative embodiment of the assembly 210 (not shown), the exterior surface 258 of the post 254 is substantially smooth and defines no ribs. The exterior surface 258 is adapted to be in frictional contact with the interior surface of the free end 16 of the leg 14 so as to create an interference fit between the exterior surface 258 and such interior surface and, thus, removably mount the insert 228 about the free end 16 of the leg 14.

To mount the assembly 10, 110, 210 to the free end 16 of a leg 14 of the chair 12, the free end 16 of the leg 14 is situated such that it is matingly received through the opened end 46, 146, 246 and within the passageway 42, 142, 242 of the insert 28, 128, 228 to removably mount the insert 28, 128, 228 about the free end 16 of the leg 14. For the case in which the free end 16 of the leg 14 is hollow and opened-ended to define an interior surface of the free end 16 of the leg 14, the post 54, 154, 254 is received through the opening of and within the free end 16 of the leg 14 with the free end 16 of the leg 14 being matingly received within the volume 56, 156, 256 defined between the post 54, 154, 254 and the interior surface 44, 144, 244 of the insert 28, 128, 228. Then, in the case of the two-piece design of the assembly 10, the bore 22 of the body 20 receives the insert 28 such that each rib 52 of the insert 28 correspondingly cooperates with each groove 50 of the body 20 to fixedly secure the body 20 about the insert 28 and, thus, free end 16 of the leg 14. The process can then be repeated for each of the remaining legs 14 of the chair 12. It should be appreciated by those having ordinary skill in the related art that the assembly 10, 110, 220 in general, and the body 20, 120, 220 and insert 28, 128, 228, in particular, can be designed to cooperatively receive a free end 16 of a leg 14 of any suitable size, shape, and structure.

Preferably, the insert 28, 128, 228 is made of plastic, in general, and either high-density polyethylene (HDPE) or nylon, in particular. The body 20, 120, 220 is made of a soft PVC material such that frictional contact between the assembly 10, 110, 220 and the floor 18 does not produce a perceptible noise and rust marks on the floor 18 when the chair 12 is moved along the floor 18. Also preferably, in a one-piece design of the assembly 110, 210, the insert 128, 228 is molded and cured, and then the body 120, 220 is molded about the insert 128, 228 in a double-mold process. In such case, each rib 160, 260 of the post 154, 254 extends in the direction of mold separation.

However, it should be appreciated by those having ordinary skill in the related art that the insert 28, 128, 228 can be made of any suitable material and the body 20, 120, 220 can be made of any suitable soft material such that it does not mar the floor 18. In the same manner, the exterior surface 30, 130, 230 of the assembly 10, 110, 210 can have any suitable texture such that frictional contact between the assembly 10, 110, 210 and the floor 18 does not produce a perceptible noise and rust marks on the floor 18 when the chair 12 is moved along the floor 18. Likewise, the exterior surface 30, 130, 230 of the assembly 10, 110, 210 can be any suitable color and have any suitable color combination so as to have a desired aesthetic appeal.

The assembly 10, 110, 210 can be easily fixedly secured to the free end 16 of a leg 14 of a piece of furniture 12. As a result, the assembly 10, 110, 210 can be retained about the leg 14 when the piece of furniture 12 is moved along a floor 18 and sufficiently contacts the floor 18. In the same manner, the assembly 10, 110, 210 cannot be manually removed from the leg 14 by relatively young students in a classroom setting, especially in an elementary school. Likewise, the assembly 10, 110, 210 is made of a soft PVC material and, thus, does not mar the floor 18 or produce a perceptible noise or rust marks on the floor 18 when the piece of furniture 12 is moved along the floor 18. Similarly, a tool is not required to fixedly secure/remove the assembly 10, 110, 210 to/from the leg 14. Also, the assembly 10, 110, 210 is sightly and professional. Furthermore, the assembly 10, 110, 210 does not collect sand, dirt, and other debris. In addition, the assembly 210 is designed to be employed with a leg 14 defining a substantially rectangular cross-section. Moreover, the assembly 110, 210 is of a one-piece design and, therefore, is easier to fixedly secure/remove about/from the leg 14 and costs less to ship relative to glides of the related art of a multi-piece design.

The present invention has been described in an illustrative manner. It is to be understood that the terminology that has been used is intended to be in the nature of words of description rather than of limitation. Many modifications and variations of the present invention are possible in light of the above teachings. Therefore, within the scope of the appended claims, the present invention may be practiced other than as specifically described.

What is claimed is:

1. A glide assembly adapted to be removably mounted to the free end of a leg of a piece of furniture, said glide assembly comprising:

a body defining a bore extending partially through said body to define an interior surface and an opened end of said body; and an insert removably mountable about the free end of the leg and disposed within said bore of said body so as to fixedly secure said body about the free end of the leg, wherein said interior surface of said body defines at least one groove, said insert defines an exterior surface including at least one rib adapted to cooperate with said at least one groove to fixedly secure said body about said insert, said insert further includes a passageway to define an upper end of said insert, and said bore of said body further defines a rim of said body that overlaps and substantially encases said upper end of said insert so as to fixedly secure said insert within said body.

2. A glide assembly as set forth in claim 1, wherein said insert defines a passageway extending at least partially through said insert to define an interior surface and at least one opened end of said insert, the free end of the leg adapted to be matingly received through at least one of said at least one opened end and within said passageway of said insert to removably mount said insert about the free end of the leg.

3. A glide assembly as set forth in claim 2, wherein said insert defines a closed end of said insert located opposite said opened end of said insert, said insert including a post extending from said closed end of said insert toward said opened end of said insert and adapted to be received through an opening of and within the free end of the leg with the free end of the leg being adapted to be matingly received between said post and said interior surface of said insert to removably mount said insert about the free end of the leg.

4. A glide assembly as set forth in claim 3, wherein said post defines an exterior surface of said post including at least one rib adapted to be in frictional contact with the interior surface of the free end of the leg to removably mount said insert about the free end of the leg.

5. A glide assembly as set forth in claim 3, wherein the horizontal cross-section of said post is substantially rectangular.

6. A glide assembly as set forth in claim 1, wherein said body is made of a soft PVC material.

7. A glide assembly as set forth in claim 1, wherein said body defines an exterior surface including a plurality of raised surfaces adapted to facilitate smooth frictional contact between said assembly and a surface on which said assembly is supported.

8. A glide assembly as set forth in claim 1, wherein said body is substantially spherical.

9. A glide assembly as set forth in claim 1, wherein the horizontal cross-section of said insert is substantially rectangular.

* * * * *